United States Patent [19]

Chen et al.

[11] Patent Number: 5,033,140

[45] Date of Patent: Jul. 23, 1991

[54] MULTIPURPOSE COMBINATION TOOL

[76] Inventors: Andy Chen, 5567 Virginia Beach Blvd., Norfolk, Va. 23502; Alan Tsao, 635 Mayflower Rd., Norfolk, Va. 23508

[21] Appl. No.: 584,538

[22] Filed: Sep. 18, 1990

[51] Int. Cl.[5] ..... B25F 1/02

[52] U.S. Cl. ..... 7/127; 7/100; 7/137; 81/15.7

[58] Field of Search ..... 7/125, 127, 137, 143, 7/129, 130, 131, 100, 132, 133; 81/15.2, 15.7

[56] References Cited

U.S. PATENT DOCUMENTS

| | | | |
|---|---|---|---|
| D. 255,539 | 6/1980 | Graham | 7/127 |
| 607,379 | 7/1898 | Jones | 81/15.7 |
| 850,319 | 4/1907 | Robinson | 7/130 |
| 1,404,866 | 1/1922 | Lahr | 7/130 |
| 3,073,191 | 1/1963 | Sharpe | 81/15.7 |
| 3,783,715 | 1/1974 | Niconchuk | 81/15.7 |

FOREIGN PATENT DOCUMENTS

| | | | |
|---|---|---|---|
| 863480 | 1/1953 | Fed. Rep. of Germany | 7/137 |
| 1064990 | 12/1953 | France | 7/127 |
| 140193 | 8/1930 | Switzerland | 7/127 |

*Primary Examiner*—Roscoe V. Parker

[57] ABSTRACT

A multi-purpose combination tool which resembles a pair of pliers and is capable of performing a number of diverse functions commonly encountered at home and/or in the shop. A tire repair kit incorporated in one of the plier-like handles includes dual punchers, a needle file, a steel rod and a sample piece of rubber.

1 Claim, 2 Drawing Sheets

MULTIPURPOSE COMBINATION TOOL

BACKGROUND OF THE INVENTION

This invention relates to a multi-purpose combination tool. It embodies a unique combination of tools that can perform such functions as to meet the needs commonly encountered in the household, namely: drive/pry nails, install/remove two types of screws (flat head, Phillips), tighten/loosen objects (plier), cut wire, impact-hammer without damaging an object (rubber mallet) and, repair tires (a uniquely designed tire-repairing kit). This invention relates also to a nail-prier of a unique design—a smoothly curved back ridge which facilitates the nail-prying function, unlike other combination tools whose head of hammer always hinder the prying action.

SUMMARY OF THE INVENTION

One of the objectives of the present invention is to provide a multi-purpose combination tool that can perform functions to meet the most commonly encountered needs in the household, such as to drive/pry nails, install/remove screws, tighten/loosen objects, cut wires, drive an object without damaging it and repair tires. The combination tool is formed on the basis of a pair of pliers, convenient to carry, easy to disassemble and assemble, and practical to use.

Another objective is to introduce an uniquely designed tire-repairing kit incorporated into the combination tool. Another objective of this invention is to create a nail-prier, as part of the combination tool, which can perform the nail-prying function more smoothly than the conventional hammer head.

DETAILED DESCRIPTION OF THE PREFERRED EMBODIMENT

Figure 1:
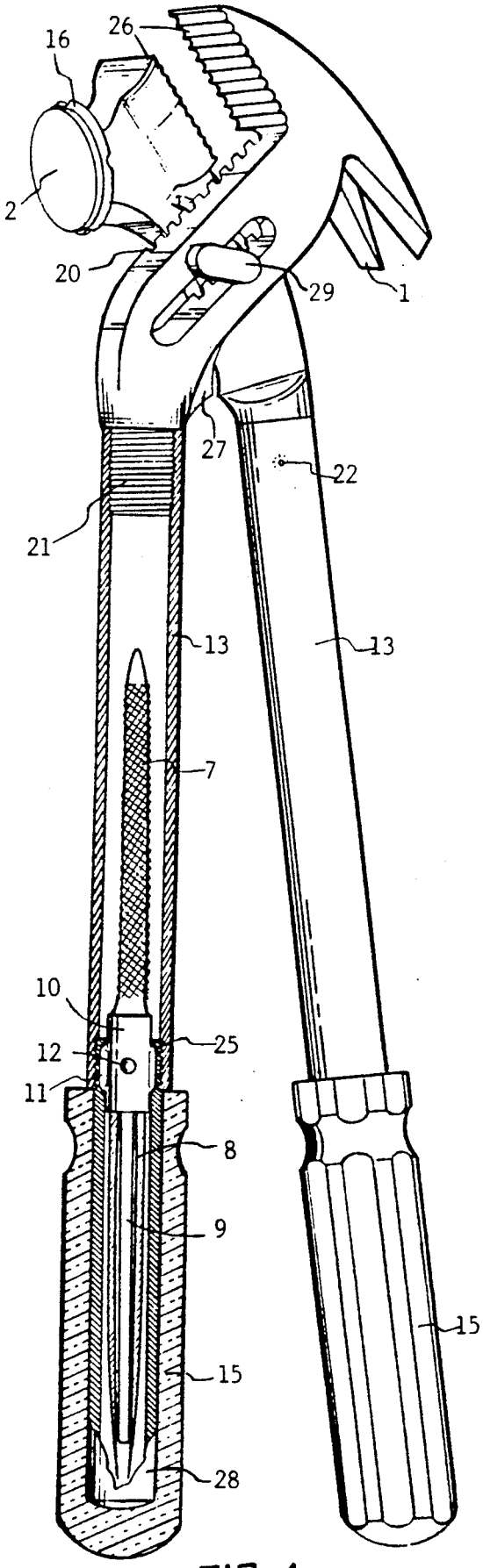
FIG. 1 is the top view of the combination tool; which resembles a pair of pliers.

Referring to FIG. 1, a pair of pliers comprises a right half and a left half. The right half of the plier as shown in FIG. 1 forms a hammer (2) when separated from the left half. The left half of the plier, when separated, performs the function of the claw (1) of a hammer in prying nails. The claw (1) has a smoothly curved back ridge which greatly facilitates the pulling of nails, in contrast to the conventional hammer whose head impedes the nail-pulling operation because of the lack of a smoothly curved extension of the claw. The two halves of the plier can easily be separated, because of the simple locking knob (29). Turning the left-half of the plier further to the left will set it loose from the right half of the plier.

FIG. 1 also illustrates the wire cutter (27), the upper part (13) of the handles, and the lower part (15) of the handles. The handles house the two types of screw drivers and the tire-repairing kit. The handles, are made of steel tubing (28) with thread (25) to insert into the upper part of the handle (13). The outer casing of the lower part (15) of the handle is made of impact-resistant plastic. Shown also are the thread (21) of the handle going into the head of the plier, and the rivet (22) securing the handle and the head.

Figure 2:
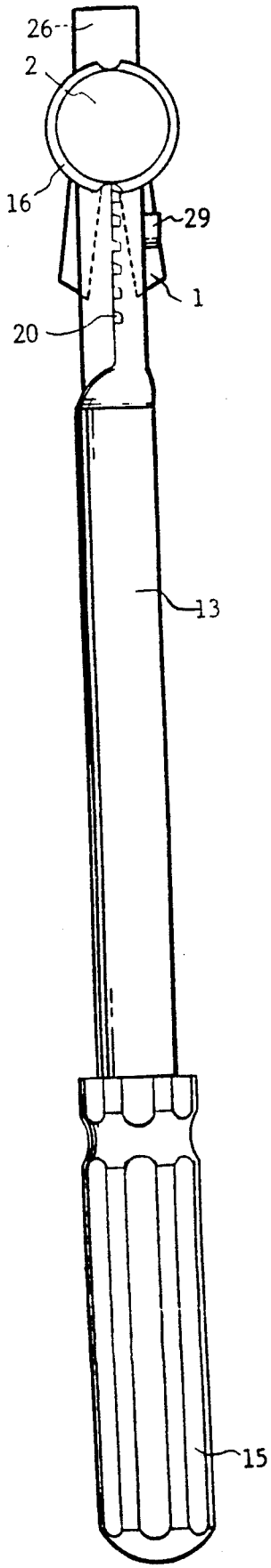
FIG. 2 is a side view of the combination tool which can easily be separated into two halves, with the right half to serve as a hammer, and the left half, as a nail-prier.

FIG. 2 is the side view of the plier, which reveals the head of the hammer (2), the groove (16) around the head for securing the detachable rubber mallet, the claw (1), the grooves (20) between the two halves of the plier to permit adjustability of the size of the plier, the upper part of the head (26) which is also the lower half of the head of the plier, and the upper part (13) of the handles. (The lower part of the handles are not shown in FIG. 2.

Figure 3:
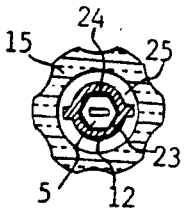
FIG. 3 is a cross-sectional view of the handle of the right half of the plier in FIG. 1.

FIG. 3 shows the cross-section of the right handle at where the plastic handle joins the steel handle. Shown in FIG. 3 are a flat-head screw driver (5), the spring-loaded steel balls (12,14), the shank (23) of the screw drivers, and the threaded tubing (25), all inside the plastic handle (15).

Figure 4:
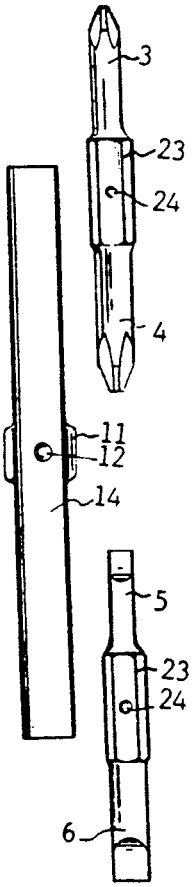
FIG. 4 shows the inside structure of the detachable handle of the right half of the plier, which contains interchangeable screwdriver bits.

FIG. 4 shows the breakdown of the flat-head (5,6) and Phillips (3,4) screw drivers. Shown also are the shank (23) of the screw drivers, with its steel ridges (11) and spring-loaded steel ball (12) to secure the screw driver sleeve (14) inside its housing.

Figure 5:
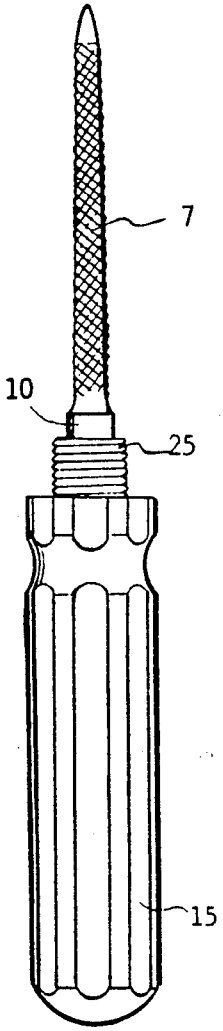
FIG. 5 illustrates a detachable handle of the left half of the plier, with its tire-repairing tool.

FIG. 5 shows the external view of the tire-repairing kit. Also in view is the needle file (7) for the tire.

Figure 6:
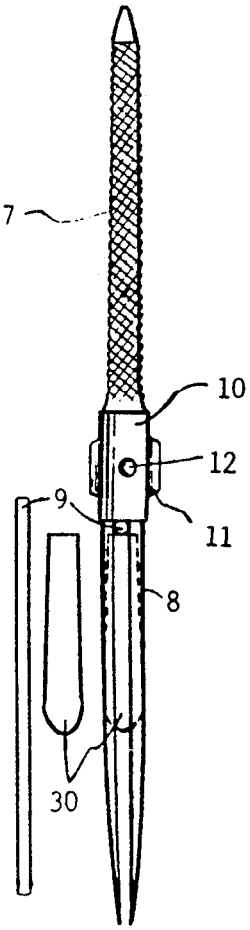
FIG. 6 shows the tire-repairing tool inside the handle of the left half of the plier.

FIG. 6 is the counter part of FIG. 4, showing the breakdown of the tire-repairing kit which consists of the needle file (7), the dual pairs of pinchers (8), a sample piece of rubber (30), and a piece of steel rod (9). The dual pairs of pinchers (8), all four pieces, are designed to insert a piece of rubber (30) into the hole of the tire. The steel rod (9) running side-wise across the top of the pinchers holds down the rubber piece in the hole of the tire while the pinchers are being retrieved from the tire.

Figure 7:
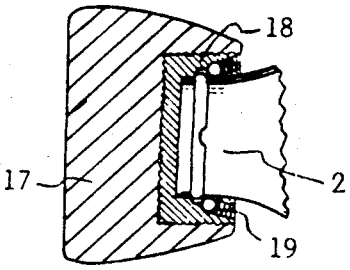
FIG. 7 illustrates the detachable head of a rubber mallet, which fits onto the head of the hammer which is the right half of the plier.

FIG. 7 is the cross-sectional view of the rubber head (17) which can be snapped onto the head (2) of the hammer.

Figure 8:
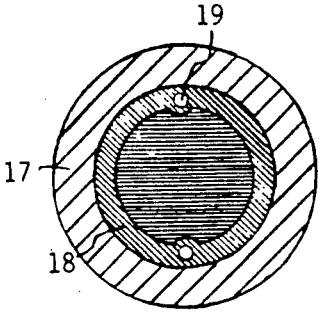
FIG. 8 is the cross-sectional view of the head of the rubber mallet.

FIG. 8 shows the inner steel casing (18) of the rubber head with two spring-loaded steel balls (19) to secure the rubber head on the hammer.

Figure 9:
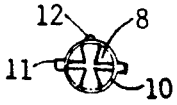
FIG. 9 is a cross-sectional view of a dual pairs of pinchers.

FIG. 9 shows the cross-section of the dual pairs of pinchers (8).

We claim:

1. A multi-purpose combination tool for performing functions most commonly encountered at home or in shop, such as: repair tires, drive/pry nails, install-/remove flat-head/Phillips screws, tighten/loosen objects with pliers, cut wires, drive objects with rubber mallet; the uniquely-designed a multi-purpose combination tool incluiding a tire-repairing tool kit consisting of dual pairs of pinchers, a needle file, and a steel rod, where the four-piece pinchers insert tire-repairing rubber into the tire and the steel rod running side-wise across the top of the pinchers holds down the rubber piece while the pinchers are being retrieved from the tire; the uniquely-designed multi-purpose combination tool further including a nail-prying claw having a smoothly curved back ridge which facilitates the nail-prying function.

* * * * *